US010260329B2

(12) United States Patent
Coward

(10) Patent No.: US 10,260,329 B2
(45) Date of Patent: Apr. 16, 2019

(54) SYSTEM AND METHOD FOR MULTIVARIABLE CONTROL IN THREE-PHASE SEPARATION OIL AND GAS PRODUCTION

(75) Inventor: Brian A. Coward, Southampton (GB)

(73) Assignee: Honeywell International Inc., Morris Plains, NJ (US)

( * ) Notice: Subject to any disclaimer, the term of this patent is extended or adjusted under 35 U.S.C. 154(b) by 2248 days.

(21) Appl. No.: 11/441,429

(22) Filed: May 25, 2006

(65) Prior Publication Data

US 2007/0275471 A1 Nov. 29, 2007

(51) Int. Cl.

| | |
|---|---|
| ***E21B 43/34*** | (2006.01) |
| ***E21B 43/00*** | (2006.01) |
| ***E21B 43/12*** | (2006.01) |
| *E21B 49/08* | (2006.01) |
| *E21B 43/38* | (2006.01) |

(52) U.S. Cl.

CPC ..... *E21B 43/34* (2013.01); *E21B 43/00* (2013.01); *E21B 43/122* (2013.01); *E21B 43/38* (2013.01); *E21B 49/08* (2013.01); *Y10T 436/12* (2015.01)

(58) Field of Classification Search

CPC ..... E21B 43/00; E21B 43/122; E21B 43/34; E21B 21/063; E21B 43/38; E21B 49/08; C11B 1/10; Y10T 436/12

USPC ..... 436/55

See application file for complete search history.

(56) References Cited

U.S. PATENT DOCUMENTS

| | | | |
|---|---|---|---|
| 4,685,522 A | 8/1987 | Dixon et al. | |
| 6,434,435 B1 | 8/2002 | Tubel et al. | |
| 6,454,002 B1 | 9/2002 | Stokes et al. | |
| 6,611,735 B1 * | 8/2003 | Henly et al. | 700/266 |
| 7,500,370 B2 * | 3/2009 | Coward | 62/657 |
| 2002/0165671 A1 | 11/2002 | Middya | |
| 2003/0097243 A1 * | 5/2003 | Mays et al. | 703/2 |
| 2004/0216514 A1 | 11/2004 | Nunnally et al. | |
| 2005/0284176 A1 | 12/2005 | Eaton et al. | |
| 2007/0227187 A1 | 10/2007 | Coward | |

(Continued)

FOREIGN PATENT DOCUMENTS

| | | |
|---|---|---|
| WO | WO 00/00715 A1 | 1/2000 |
| WO | WO 2004/038535 A2 | 5/2004 |
| WO | WO 2004/070569 A2 | 8/2004 |

OTHER PUBLICATIONS

Palke, Miles R. et al. "Nonlinear Optimization of Well Production Considering Gas Lift and Phase Behavior," Society of Petroleum Engineers (SPE), SPE 37428, SPE Production Operations Symposium—Mar. 1997, p. 1-16.*

(Continued)

*Primary Examiner* — Lyle Alexander

*Assistant Examiner* — Bryan Kilpatrick

(57) ABSTRACT

A method includes controlling an oil and gas extraction process, controlling a production separation process, and controlling a de-gassing process. The method also includes optimizing the oil and gas extraction process, the production separation process, and the degassing process to optimize at least one process objective. The method could further include controlling a lift-gas compression process. The optimizing could include optimizing the lift-gas compression process, the oil and gas extraction process, the production separation process, and the degassing process to optimize the at least one process objective.

20 Claims, 3 Drawing Sheets

(56) References Cited

U.S. PATENT DOCUMENTS

2007/0276542 A1* 11/2007 Coward ..... 700/273

OTHER PUBLICATIONS

K. K. Lo, "Optimum Lift-Gas Allocations Under Multiple Production Constraints", Society of Petroleum Engineers, vol. SPE, No. 26017, Dec. 7, 1992, pp. 1-23.
Saputelli et al., Self-Learning Reservoir Management, SPE Reservoir Evaluation and Engineering, vol. SPE, No. 84064, Dec. 2005, pp. 534-547.
Stenhouse, B. Learning on Sustainable Model-Based Optimisation-the Valhall Optimiser Field Trial, Society of Petroleum Engineers, vol. SPE, No. 99828, Apr. 13, 2006, pp. 1-15.
Saputelli et al., Promoting Real-time Optimization of Hydrocarbon Producing Systems, EPE Annual Technical Conference and Exhibition, vol. SPE No. 83978, Sep. 2, 2003, pp. 1-9.
European Patent Office, "Communication pursuant to Article 94(3) EPC," Application No. 07 762 297.5-1605, dated Nov. 11, 2016, 6 pages, publisher EPO, Rijswijk, Netherlands.

* cited by examiner

100

SYSTEM AND METHOD FOR MULTIVARIABLE CONTROL IN THREE-PHASE SEPARATION OIL AND GAS PRODUCTION

TECHNICAL FIELD

This disclosure relates generally to process control systems and more particularly to a system and method for multivariable control in three-phase separation oil and gas production systems.

BACKGROUND

In "upstream" production at an oil or gas reservoir, production declines over time as reserves are removed. Equipment in the associated production facility is designed and typically operated for the peak production conditions. Over time, as the hydrocarbon production rate from the reservoir drops, extra capacity appears on the process equipment.

In typical systems, the processing equipment in the production facility, such as three-phase separators, hydrocyclones, compressors, dehydration equipment, and pumps, are all configured and optimized for most efficient production only under optimal conditions. There is currently no overall production control system for optimizing the production process even as the reserves are removed.

SUMMARY

This disclosure provides a system and method for multivariable control in three-phase separation oil and gas production systems.

In a first embodiment, a method includes controlling an oil and gas extraction process, controlling a production separation process, and controlling a de-gassing process. The method also includes optimizing the oil and gas extraction process, the production separation process, and the degassing process to optimize at least one process objective.

In a particular embodiment, the method also includes controlling a lift-gas compression process. Also, the optimizing includes optimizing the lift-gas compression process, the oil and gas extraction process, the production separation process, and the degassing process to optimize the at least one process objective.

In a second embodiment, a computer program is embodied in a computer readable medium. The computer program includes computer readable program code for controlling an oil and gas extraction process, controlling a production separation process, and controlling a de-gassing process. The computer program also includes computer readable program code for optimizing the oil and gas extraction process, the production separation process, and the degassing process to optimize at least one process objective.

In a third embodiment, a system includes an oil and gas extraction process control system, a production separation process control system, and a de-gassing process control system. The system also includes a production process control system including a multivariable controller configured to concurrently control and optimize the oil and gas extraction process control system, the production separation process control system, and the de-gassing process control system.

Other technical features may be readily apparent to one skilled in the art from the following figures, descriptions, and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

Figure 1:
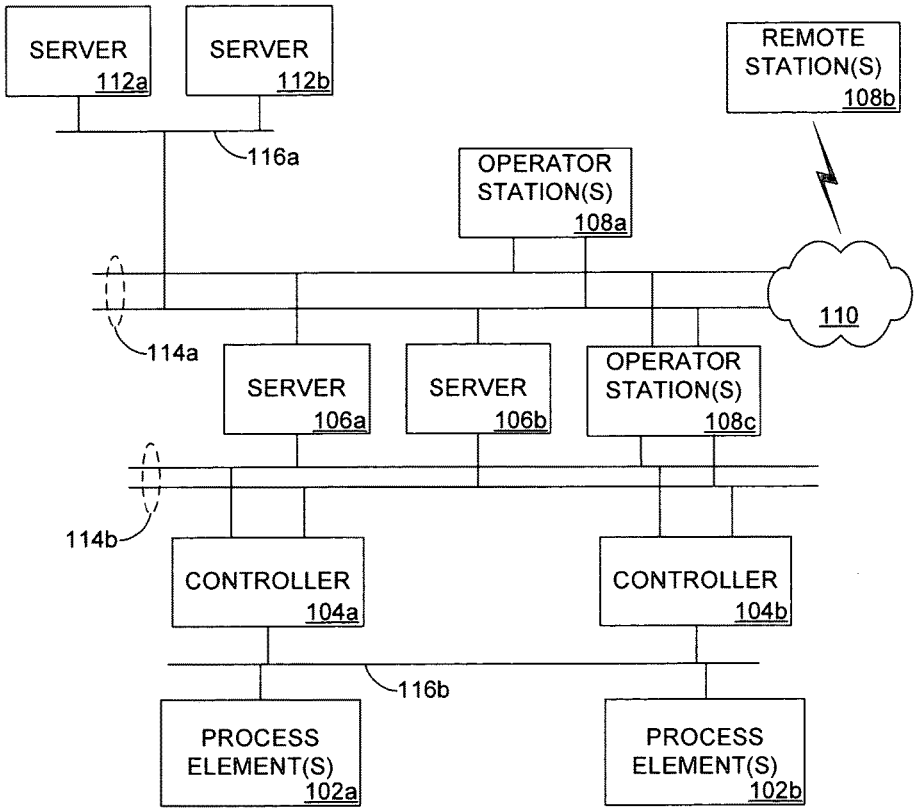
FIG. 1 illustrates an example process control system according to one embodiment of this disclosure.

FIG. 1 illustrates an example process control system 100 according to one embodiment of this disclosure. The embodiment of the process control system 100 shown in FIG. 1 is for illustration only. Other embodiments of the process control system 100 may be used without departing from the scope of this disclosure.

In this example embodiment, the process control system 100 includes one or more process elements 102*a*-102*b*. The process elements 102*a*-102*b* represent components in a process or production system that may perform any of a wide variety of functions. For example, the process elements 102*a*-102*b* could represent motors, catalytic crackers, valves, and other industrial equipment in a production environment. The process elements 102*a*-102*b* could represent any other or additional components in any suitable process or production system. Each of the process elements 102*a*-102*b* includes any hardware, software, firmware, or combination thereof for performing one or more functions in a process or production system. While only two process elements 102*a*-102*b* are shown in this example, any number of process elements may be included in a particular implementation of the process control system 100.

Two controllers 104*a*-104*b* are coupled to the process elements 102*a*-102*b*. The controllers 104*a*-104*b* control the operation of the process elements 102*a*-102*b*. For example, the controllers 104*a*-104*b* could be capable of monitoring the operation of the process elements 102*a*-102*b* and providing control signals to the process elements 102*a*-102*b*. Each of the controllers 104*a*-104*b* includes any hardware, software, firmware, or combination thereof for controlling one or more of the process elements 102*a*-102*b*. The controllers 104*a*-104*b* could, for example, include processors 105 of the POWERPC processor family running the GREEN HILLS INTEGRITY operating system or processors 105 of the X86 processor family running a MICROSOFT WINDOWS operating system.

Two servers 106*a*-106*b* are coupled to the controllers 104*a*-104*b*. The servers 106*a*-106*b* perform various functions to support the operation and control of the controllers 104*a*-104*b* and the process elements 102*a*-102*b*. For example, the servers 106*a*-106*b* could log information collected or generated by the controllers 104*a*-104*b*, such as status information related to the operation of the process elements 102*a*-102*b*. The servers 106*a*-106*b* could also execute applications that control the operation of the controllers 104*a*-104*b*, thereby controlling the operation of the process elements 102*a*-102*b*. In addition, the servers 106*a*-106*b* could provide secure access to the controllers 104*a*-104*b*. Each of the servers 106*a*-106*b* includes any hardware, software, firmware, or combination thereof for providing access to or control of the controllers 104*a*-104*b*. The servers 106*a*-106*b* could, for example, represent personal computers (such as desktop computers) executing a MICROSOFT WINDOWS operating system. As another example, the servers 106*a*-106*b* could include processors of the POWERPC processor family running the GREEN HILLS INTEGRITY operating system or processors of the X86 processor family running a MICROSOFT WINDOWS operating system.

One or more operator stations 108*a*-108*b* are coupled to the servers 106*a*-106*b*, and one or more operator stations 108*c* are coupled to the controllers 104*a*-104*b*. The operator stations 108*a*-108*b* represent computing or communication devices providing user access to the servers 106*a*-106*b*, which could then provide user access to the controllers 104*a*-104*b* and the process elements 102*a*-102*b*. The operator stations 108*c* represent computing or communication devices providing user access to the controllers 104*a*-104*b* (without using resources of the servers 106*a*-106*b*). As particular examples, the operator stations 108*a*-108*c* could allow users to review the operational history of the process elements 102*a*-102*b* using information collected by the controllers 104*a*-104*b* and/or the servers 106*a*-106*b*. The operator stations 108*a*-108*c* could also allow the users to adjust the operation of the process elements 102*a*-102*b*, controllers 104*a*-104*b*, or servers 106*a*-106*b*. Each of the operator stations 108*a*-108*c* includes any hardware, software, firmware, or combination thereof for supporting user access and control of the system 100. The operator stations 108*a*-108*c* could, for example, represent personal computers having displays and processors executing a MICROSOFT WINDOWS operating system.

In this example, at least one of the operator stations 108*b* is remote from the servers 106*a*-106*b*. The remote station is coupled to the servers 106*a*-106*b* through a network 110. The network 110 facilitates communication between various components in the system 100. For example, the network 110 may communicate Internet Protocol (IP) packets, frame relay frames, Asynchronous Transfer Mode (ATM) cells, or other suitable information between network addresses. The network 110 may include one or more local area networks (LANs), metropolitan area networks (MANs), wide area networks (WANs), all or a portion of a global network such as the Internet, or any other communication system or systems at one or more locations.

In this example, the system 100 also includes two additional servers 112*a*-112*b*. The servers 112*a*-112*b* execute various applications to control the overall operation of the system 100. For example, the system 100 could be used in a processing or production plant or other facility, and the servers 112*a*-112*b* could execute applications used to control the plant or other facility. As particular examples, the servers 112*a*-112*b* could execute applications such as enterprise resource planning (ERP), manufacturing execution system (MES), or any other or additional plant or process control applications. Each of the servers 112*a*-112*b* includes any hardware, software, firmware, or combination thereof for controlling the overall operation of the system 100.

As shown in FIG. 1, the system 100 includes various redundant networks 114*a*-114*b* and single networks 116*a*-116*b* that support communication between components in the system 100. Each of these networks 114*a*-114*b*, 116*a*-116*b* represents any suitable network or combination of networks facilitating communication between components in the system 100. The networks 114*a*-114*b*, 116*a*-116*b* could, for example, represent Ethernet networks. The process control system 100 could have any other suitable network topology according to particular needs.

Although FIG. 1 illustrates one example of a process control system 100, various changes may be made to FIG. 1. For example, a control system could include any number of process elements, controllers, servers, and operator stations.

Figure 2:
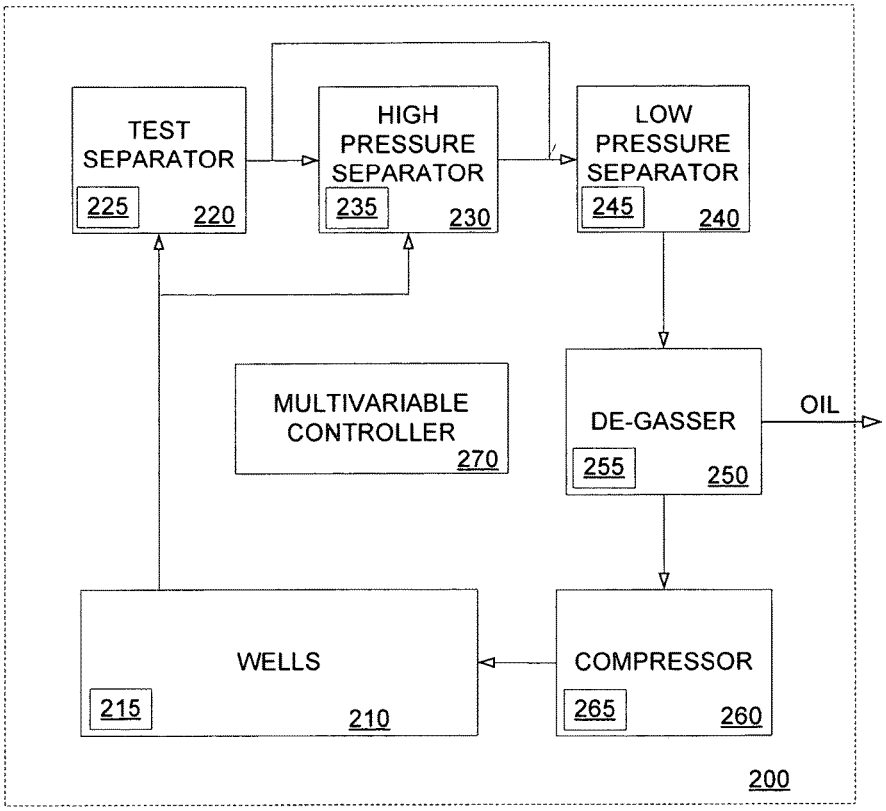
FIG. 2 illustrates an example process control system for an oil and gas production process according to one embodiment of this disclosure.

FIG. 2 illustrates an example process control system 200 for an oil and gas production process according to one embodiment of this disclosure. The embodiment of the process control system 200 shown in FIG. 2 is for illustration only. Other embodiments of the process control system 200 may be used without departing from the scope of this disclosure.

In some embodiments, the processing equipment in an oil and gas production facility, such as three-phase separators, hydrocyclones, compressors, dehydration equipment, and pumps, are controlled by level, pressure, and flow-control loops. By running these control loops while monitoring their interaction with other control loops and with a common aim (such as increasing the profitability of the process), the overall utilization of the production equipment capacity can be increased. By coordinating the control of compressors, gas turbines, choke valves, and/or other equipment and by driving against operational constraints, increased production of a more valuable product can be achieved.

As shown in FIG. 2, compressor 260 injects lift gas into wells 210. Compressor 260 can be powered by a fuel gas from an external fuel supply or in any other suitable manner. Compressor 260 can be controlled by a lift-gas compression process control system 265. Wells 210 can be controlled by well process control system 215.

The production from the wells 210, including oil, water, other fluids, and gasses, is passed to test separator 220, then to high pressure separator 230, then to low pressure separator 240. Test separator 220 can be controlled by a test separator process control system 225. High pressure separator 230 can be controlled by a high pressure separator process control system 235. Low pressure separator 240 can be controlled by a low pressure separator process control system 245. In some embodiments, a single separator process control system can function as test separator process control system 225, high pressure separator process control system 235, and low pressure separator process control system 245.

Water and oil are separated by separators 230, and the water is removed. The remaining oil/gas mixture is then passed to de-gasser 250, which can be controlled by de-gasser process control system 255. Oil is removed for storage or other processing, while any separated lift gas is returned to compressor 260 to be reused.

This simplified diagram does not include each individual compressor, pump, valve, switch, and other mechanical and electromechanical process elements used in the process. Such elements and their use in an oil and gas production system are known to those of skill in the art.

The compressor 260, wells 210, test separator 220, high pressure separator 230, low pressure separator 240, and de-gasser 250 can each include multiple process elements and one or more process controllers (as described with relation to FIG. 1) to optimize the processes and variables as described herein. Each of these is further connected to communicate with and be controlled by multivariable controller 270 as described herein, although these connections are not shown in FIG. 2 for the sake of clarity. In various embodiments, the well production may not pass through every separation phase and may only pass through one or more of the separation phases depicted in FIG. 2.

While the process control system 200 depicted in FIG. 2 is drawn to an oil and gas production facility for the purposes of illustrating the techniques described herein, the process optimization techniques discussed herein can also be applied to other hydrocarbon production facilities as will be understood by those of skill in the art. For example, in other embodiments, there may not be a lift gas compressor. In some processes, the gas is compressed and exported, which would require a product stream from the compression box and no gas lift.

An application can be configured to run and control a particular section of an operating process and can be configured to maximize profit, quality, production, or other objectives. Each application may be configured with manipulated variables (MV), controlled variables (CV), disturbance variables (DV), and a control horizon over which to ensure that the variables are brought inside the limits specified by the operator. A controlled variable represents a variable that a controller attempts to maintain within a specified operating range or otherwise control. A manipulated variable represents a variable manipulated by the controller to control a controlled variable. A disturbance variable represents a variable that affects a controlled variable but that cannot be controlled by the controller.

In particular embodiments, to ensure that an application utilizes any degrees of freedom to increase profitability or other defined objectives, the application may be configured with either linear program (LP) economics or quadratic program (QP) economics. These two different economic optimization approaches use a minimization strategy described below, and the quadratic optimization also uses ideal resting values (or desired steady state values). The general form of an objective function is: Minimize $$J = \sum_i b_i \times CV_i + \sum_i a_i^2 (CV_i - CV_{0i})^2 + \sum_j b_j \times MV_j + \sum_j a_{j2} (MV_j - MV_{0j})^2,$$

where:

$b_i$ represents the linear coefficient of the $i^{th}$ controlled variable;

$b_j$ represents the linear coefficient of the $j^{th}$ manipulated variable;

$a_i$ represents the quadratic coefficient of the $i^{th}$ controlled variable;

$a_j$ represents the quadratic coefficient of the $j^{th}$ manipulated variable;

$CV_i$ represents the actual resting value of the $i^{th}$ controlled variable; and $CV_{0i}$ represents the desired resting value of the $i^{th}$ controlled variable;

$MV_j$ represents the actual resting value of the $j^{th}$ manipulated variable; and $MV_{0j}$ represents the desired resting value of the $j^{th}$ manipulated variable.

As shown here, the optimization for each application can be complex since the scope of an application may contain upwards of twenty variables, each able to be incorporated into either a linear or quadratic optimization objective. Given that the production process may be sequential and that altering the limits on a product quality or rate on one application may affect another application, there is coordination between the various applications.

The following represents examples of how the various applications in the various process control systems may operate alone or in combination. These examples are for illustration and explanation only. The various applications could perform any other or additional operations according to particular needs.

One objective of multivariable control software is to reduce and negate the interactions between control loops in an industrial context. The upstream production process is a highly interactive process because the natural pressure that exists in the hydrocarbon reservoir "drives" the material through the process. Because of the remote location of the production facilities, all of the power used in the process is typically generated locally, which means that it is expensive to add equipment such as pumps to the process. This energy saving introduces coupling between vessels and transmits disturbances between the control loops. It also encourages the operator to run the process with a "comfort zone" to ensure that the transmitted disturbances are handled without adversely affecting the process.

Pressure is generally maintained in the process through either pressure controllers or compressors. Coordinating the setpoint of these pressure controllers (or performance controls on compressors) means that the pressure in the front end of the process, where the hydrocarbon material enters from the pipeline from the reservoir, can be reduced to the minimum operational point. There is a well-documented and understandable relationship between the pressure at the wellhead (and therefore at the inlet to the processing equipment) and the production rate for a fixed choke valve position.

If one variable in the process is adjusted, then the interactive nature results in other controllers in the system having to move to compensate. This interaction is what is utilized by the multivariable control techniques disclosed herein to deliver benefits to the customer.

Adjusting either the pressure controllers on the separators or the suction pressure of the compressors results in a pressure balance change across the production process. Where there are multiple compressors in series, each of the suction (or discharge) pressures can be adjusted to use the compression capacity to the optimum.

One benefit of the disclosed multivariable control techniques is that the technology moves from a single control loop perspective to the holistic perspective that considers the effect of a change of each manipulated variable across the entire process. In a highly interactive environment such as an offshore process, this can add significant benefits when the control problem is correctly characterized.

In the disclosed multivariable control system and method, the operational problem may be characterized in terms of manipulated, controlled and disturbance variables. The manipulated variables are the control loops or elements that actually affect the control and include basic control loops and actuated valves. The controlled variables are the operational and economic constraints to which the process is bound and may include valve positions or mechanical limitations (such as that a compressor cannot physically operate beyond its design pressure).

The process also needs to be characterized, whether the production liquids are gas, water and condensed light materials (condensate) or gas, water and oil. These two processes, although requiring the same technology, require different approaches.

Gas, condensate and water: Because the reservoir containing the hydrocarbon is at a higher pressure, there is no need for compression on the typical gas and condensate process. Instead, the hydrocarbon flows through the processing equipment under its own pressure. Because the hydrocarbons being processed are light (low density), they are easy to separate from the associated water. Therefore, the processing is simple, involving separation from the water followed by dehydration of the hydrocarbon liquid and gas phases.

In this embodiment, a typical application has two objectives: to minimize the back-pressure on the process and enable the maximum throughput (subject to the process constraints) and to maximize the yield of the condensate from the reservoir. This may involve the control of the choke valves to maximize the yield from the economically highest value wells while honoring the process throughput constraints. Economically highest value is typically the wells yielding the largest amount of condensate per volume of gas or having the highest condensate to gas ratio (CGR).

For this application, the typical multivariable control matrix consists of the following manipulated variables:

| | |
|---|---|
| Number of chokes - choke flow controllers | The chokes can be run either in automatic or manual modes depending upon requirements. Base load wells may be step tested and may be run as disturbance variables. |
| Number of gas trains - gas train differential controller | A differential pressure controller or a train back pressure controller can be used. If the back pressure controller is used then an additional controlled variable of the differential pressure can be added to the application. |

The multivariable controller matrix may also include at least the following controlled variables. Additional constraints can be added depending upon operational subtleties in the different processes as will be recognized by those of skill in the art.

| | |
|---|---|
| Export line pressure | Constraint on operation from the process. |
| Train condensate flow | Optimization CV, based on the condensate leaving the trains on the process. May be more than one constraint, dependant on the number of trains. |
| Train delta flow | CV to ensure trains are equally loaded against the required rate on the OGP. One controlled variable per two trains. |
| Well flows | May only be applicable if chokes are used in manual mode and there is a limitation on the flow from any well. In this case, there may be one controlled variable per choke valve. |
| Train pressure controller output | Constraint CV to prevent the process from being pushed too far and the control valves saturating. One controlled variable per train. |
| Train differential pressure controller output | Constraint CV to prevent the process from being pushed too far and the control valves saturating. One controlled variable per train. |

-continued

| | |
|---|---|
| Train condensate separator level controller output | Constraint on condensate production and pressure reduction. One controlled variable per train. |
| Train delta differential pressure | CV to ensure trains are not imbalanced with regard to pressure. Number of CVs may depend on the number of separate trains on the process. |
| Total production | Production constraint for the entire process. |
| Process condensate gas ratio | Optimization variable to enable the application to determine the optimal economics. |

The application can also be configured with disturbance variables, but these may be specific to specific implementations as will be recognized by those of skill in the art. Because they may not be generic, they may not be generally stated.

Gas, oil and water: In an oil producing process in accordance with the disclosed embodiments, the reservoir is typically at a lower pressure and temperature than the gas and condensate process. The density of crude oil, compared to condensate, is also typically higher. This typically causes higher back-pressure on the reservoir, meaning that pressure is used up driving the material to the surface.

Because of the lower pressure operation, compressors are often required on the majority of the processes to attain a high enough pressure on the gas stream for export. Where the crude density is high, the amount of gas evolved can be very low. Therefore, it may not be economically viable to utilize a compressor, so the gas may be flared instead of exported.

Where a compressor is used and the production profile for the asset in question is in decline, the compressor can be moved on its operational curve to deliver more head with lower throughput, assuming it is fixed in speed. With a variable speed, performance controlled compressor, the operational point can be moved in two directions. This manipulation of the operational point therefore enables the separators on the process to be run at lower pressures. This reduction in pressure delivers a lower pressure at the wellhead and enables increased flowrates from the reservoir (i.e. increased production rates).

For this application, the typical multivariable control matrix consists of the following manipulated variables:

| | |
|---|---|
| Number of separators - separator pressure controller | The pressure controller may be on the separator, but some processes can be configured without these controllers. If they exist, they may also be included. One manipulated variable per separator. |
| Number of compressors - compressor performance control (suction or discharge pressure) | Performance control, adjusting the suction throttle valve or the recycle valve, or both. There may be one controller per compressor or compressor stage. |
| Number of compressor stages - compressor | Temperature controller on the cooler for the gas |

-continued

| | |
|---|---|
| suction cooler temperature controller | entering the compressor. The temperature impacts the quantity of heavier components removed from the gas and therefore the calorific value of the remaining gas. |
| Backpressure controller | Pressure controller on the rear of the process maintaining sufficient pressure to get the gas into the export line. |
| Degassing drum pressure controller | Pressure controller on the produced water drum where the remaining gas is evolved from the water before the water is reinjected or dumped overboard. This pressure is normally constrained by the flare pressure at which this drum is operated. |

The multivariable controller matrix may include at least the following controlled variables. Additional constraints may be added depending upon operational subtleties in the different processes.

| | |
|---|---|
| Separator oil level controller output | Pressure reduction constraint, ensuring sufficient pressure exists between separators to drive the oil through the process. One per separator oil level controller. |
| Separator water level controller output | Pressure reduction constraint, the output of the controller defines. One per separator water level controller. |
| Separator pressure controller output | Constraint to prevent the pressure controller becoming saturated. One per separator water level controller. |
| Hydrocyclone differential pressure ratio/differential pressure ratio controller output | Operational constraint on the separation of the water and oil before the water is rejected from the process. Differential pressure indicates the water quality and the differential pressure controller is therefore a key operational constraint. One per hydrocyclone differential pressure ratio controller. |
| Compressor proximity to surge | Constraint on the mechanical and operational limitation on the compressor. Although surge controls exist to protect the equipment, the application could never run the compressor close to the surge line. |
| Compressor inlet temperature | Physical or metallurgical limitation on the operation of the compressor |
| Compressor suction temperature controller output | Constraint on optimization - proximity of the control loop to saturation. One constraint variable per temperature controller manipulated variable. |

-continued

| | |
|---|---|
| Turbine limitation/ exhaust gas temperature constraint | Constraint on the gas turbine operation. Typically this is the exhaust gas (or T5) temperature. One constraint per turbine. |
| Compressor outlet temperature | Metallurgical and mechanical constraint on the operation of the compressor. One constraint could exist per compressor stage or per single stage compressor. |
| Main oil line pump suction pressure | Mechanical constraint on the Net Positive Suction Head requirement of the pump(s) |
| Main oil line pump current draw | Operational constraint on the requirements of the export pumps on the process. |

The disturbance variables included into the application could include the following variables:

| | |
|---|---|
| Gas export line pipeline pressure | The variable is a major disturbance to the process. |

Figure 3:
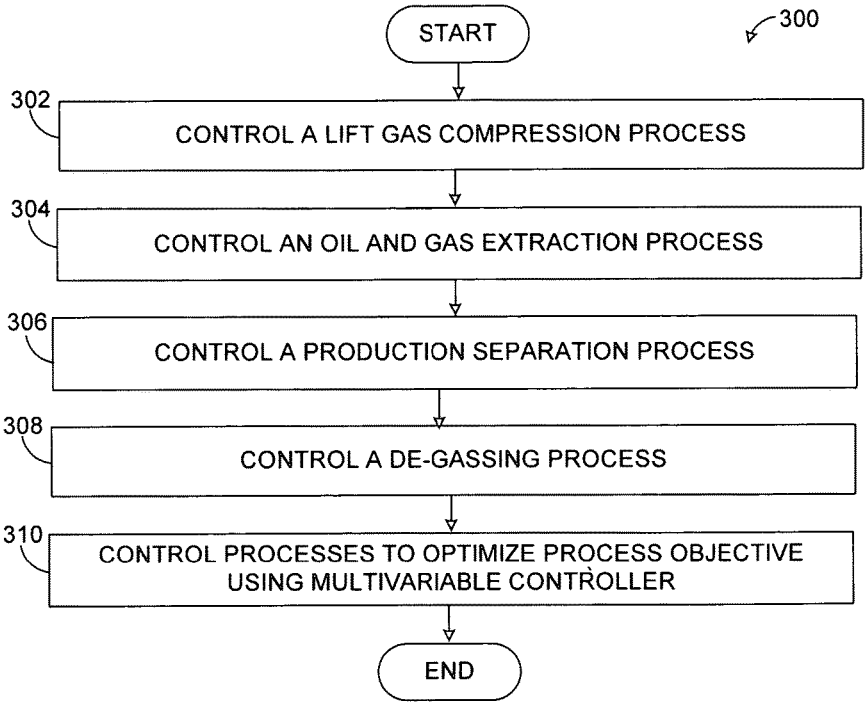
FIG. 3 illustrates an example method for multivariable control in an oil and gas production process according to one embodiment of this disclosure.

FIG. 3 illustrates an example method 300 for multivariable control in an oil and gas production process according to one embodiment of this disclosure.

One step includes controlling a lift-gas compression process at step 302 for compressing lift gas. This control process can include controlling and compensating for particular manipulated variables, controlled variables, and disturbance variables as described above. The lift-gas compression process can be controlled using a lift-gas compression process control system.

Another step includes controlling an oil and gas extraction process at step 304 for injecting compressed lift gas into wells to increase extraction and production from the wells. This control process can include controlling and compensating for particular manipulated variables, controlled variables, and disturbance variables as described above. The lift-gas extraction process can be controlled using a well process control system.

Another step includes controlling a production separation process at step 306 to separate the extraction product into oil, water, lift gas, and other components. This control process can include controlling and compensating for particular manipulated variables, controlled variables, and disturbance variables as described above. It can also be performed using multiple stages and processes, such as a test separation process, a high pressure separation process, and a low pressure separation process. The production separation process can be controlled using a production separation process control system or multiple process control systems for each separate stage. Separated water can be discarded.

Another step includes controlling a de-gassing process at step 308 to remove gas from the oil. The separated lift gas can be delivered back to compressor 260, while oil can then be stored or further processed.

Another step includes concurrently controlling the lift-gas compression process, the oil and gas extraction process, the production separation process, and the degassing process to optimize at least one process objective at step 310. For example, these processes, along with their respective manipulated variables, controlled variables, and disturbance variables, may be controlled together to optimize at least one process objective. Objectives can include, for example, maximum oil production and maximum process profit. Another objective could be to minimize the back-pressure on the process and enable the maximum throughput, subject to the process constraints. Yet another objective could be to maximize the yield of the condensate from the reservoir. The optimization can be performed using a production process control system including a multivariable controller 270 that can concurrently control and optimize the various process control systems shown in FIG. 2.

Although FIG. 3 illustrates one example of a method 300 for multivariable control in an oil and gas production process, various changes may be made to FIG. 3. For example, one, some, or all of the steps may occur as many times as needed. Also, while shown as a sequence of steps, various steps in FIG. 3 could occur in parallel or in a different order. As a particular example, all steps shown in FIG. 3 could be performed in parallel.

In some embodiments, the various functions performed in conjunction with the systems and methods disclosed herein are implemented or supported by a computer program that is formed from computer readable program code and that is embodied in a computer readable medium. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory.

It may be advantageous to set forth definitions of certain words and phrases used throughout this patent document. The term "couple" and its derivatives refer to any direct or indirect communication between two or more elements, whether or not those elements are in physical contact with one another. The term "application" refers to one or more computer programs, sets of instructions, procedures, functions, objects, classes, instances, or related data adapted for implementation in a suitable computer language. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. The term "controller" means any device, system, or part thereof that controls at least one operation. A controller may be implemented in hardware, firmware, software, or some combination of at least two of the same. The functionality associated with any particular controller may be centralized or distributed, whether locally or remotely.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A method, comprising:

performing a single oil production process comprising:

performing an extraction process to obtain a product containing oil, water, and lift gas from a well;

passing the product to a test separator followed by a second separator at a first pressure followed by a third separator at a second pressure to separate the water and the oil from the product, wherein the test separator is controlled by a test separator process control system, the second separator is controlled by a second separator process control system and the third separator is controlled by a third separator process control system, wherein the second pressure is lower than the first pressure; and passing the remaining oil mixture to a de-gasser controlled by a de-gasser process control system, wherein the lift gas is separated from the oil and the oil is removed for storage and the separated lift gas returned to at least one compressor for reuse in the well, and controlling the single oil production process using a multivariable control matrix comprising a plurality of manipulated and controlled variables to control at least one process objective comprising backpressure and throughput of the single oil production process;

wherein the plurality of manipulated variables includes at least a suction pressure of the at least one compressor, a temperature associated with the lift gas at an inlet or outlet of the at least one compressor, and a degassing drum pressure associated with the de-gasser.

2. The method of claim 1, wherein the at least one process objective further comprises at least one of: maximum oil production, maximum process profit, and maximum yield of condensate from a reservoir.

3. The method of claim 1, wherein the optimizing is performed using a multivariable controller.

4. The method of claim 1, wherein the controlling further uses one or more controlled variables that include at least one of: a separator oil level controller output, a separator water level controller output, a separator pressure controller output, and a hydrocyclone differential pressure ratio controller output.

5. The method of claim 1, wherein the controlling further uses one or more controlled variables that include at least one of: a compressor proximity to surge, a turbine exhaust gas temperature constraint, a main oil line pump suction pressure, and a main oil line pump current draw.

6. The method of claim 1, wherein the controlling further uses one or more disturbance variables that include a gas export line pipeline backpressure.

7. A non-transitory computer readable medium embodying a computer program, the computer program comprising computer readable program code for:

controlling performance of a single oil production process comprising:

performing an extraction process to obtain a product containing oil, water, and lift gas from a well;

passing the product to a test separator followed by a second separator at a first pressure followed by a third separator at a second pressure to separate the water and the oil from the product, wherein the test separator is controlled by a test separator process control system, the second separator is controlled by a second separator process control system and the third separator is controlled by a third separator process control system, wherein the second pressure is lower than the first pressure; and passing the remaining oil mixture to a de-gasser controlled by a de-gasser process control system, wherein the lift gas is separated from the oil and the oil is removed for storage and the separated lift gas returned to at least one compressor for reuse in the well, and controlling the single oil production process using a multivariable control matrix comprising a plurality of manipulated and controlled variables to control at least one process objective comprising backpressure and throughput of the single oil production process;

wherein the plurality of manipulated variables includes at least a suction pressure of the at least one compressor, a temperature associated with the lift gas at an inlet or outlet of the at least one compressor, and a degassing drum pressure associated with the de-gasser.

8. The computer readable medium of claim 7, wherein the at least one process objective further comprises at least one of: maximum oil production, maximum process profit, and maximum yield of condensate from a reservoir.

9. The computer readable medium of claim 7, wherein the computer program is executed by a multivariable controller.

10. The computer readable medium of claim 7, wherein the computer readable program code for controlling further uses one or more controlled variables that include at least one of: a separator oil level controller output, a separator water level controller output, a separator pressure controller output, and a hydrocyclone differential pressure ratio controller output.

11. The computer readable medium of claim 7, wherein the computer readable program code for controlling further uses one or more controlled variables that include at least one of: a compressor proximity to surge, a turbine exhaust gas temperature constraint, a main oil line pump suction pressure, and a main oil line pump current draw.

12. The computer readable medium of claim 7, wherein the computer readable program code for controlling further uses one or more disturbance variables that include a gas export line pipeline backpressure.

13. A system, comprising:

an extraction process control system configured to control a single oil production process comprising:

performing an extraction process to obtain a product containing oil, water, and lift gas from a well;

passing the product to a test separator followed by a second separator at a first pressure followed by a third separator at a second pressure to separate the water and the oil from the product, wherein the test separator is controlled by a test separator process control system, the second separator is controlled by a second separator process control system and the third separator is controlled by a third separator process control system, wherein the second pressure is lower than the first pressure; and passing the remaining oil mixture to a de-gasser controlled by a de-gasser process control system, wherein the lift gas is separated from the oil and the oil is removed for storage and the separated lift gas returned to at least one compressor for reuse in the well, and a production process control system including a multivariable controller configured to concurrently control and optimize the extraction process control system according to at least one process objective comprising backpressure and throughput of the single oil production process;

wherein the multivariable controller is operable to use a multivariable control matrix comprising a plurality of controlled and manipulated variables that includes at least a suction pressure of the at least one compressor, a temperature associated with the lift gas at an inlet or outlet of the at least one compressor, and a degassing drum pressure associated with the de-gasser.

14. The system of claim 13, wherein the at least one process objective further comprises at least one of: maximum oil production, maximum process profit, and maximum yield of condensate from a reservoir.

15. The system of claim 13, wherein the multivariable controller is further operable to use one or more controlled variables that include at least one of: a separator oil level controller output, a separator water level controller output, a separator pressure controller output, and a hydrocyclone differential pressure ratio controller output.

16. The system of claim 13, wherein the multivariable controller is further operable to use one or more controlled variables that include at least one of: a compressor proximity to surge, a turbine exhaust gas temperature constraint, a main oil line pump suction pressure, and a main oil line pump current draw.

17. The system of claim 13, wherein the multivariable controller is further operable to use one or more disturbance variables that include a gas export line pipeline backpressure.

18. The method of claim 1, wherein the at least one compressor is configured to inject the lift gas into at least one well.

19. The computer readable medium of claim 7, wherein the at least one compressor is configured to inject the lift gas into the well.

20. The system of claim 13, wherein the at least one compressor is configured to inject the lift gas into the well.

* * * * *